US006520753B1

(12) United States Patent
Grosjean et al.

(10) Patent No.: US 6,520,753 B1
(45) Date of Patent: Feb. 18, 2003

(54) PLANAR MICROPUMP

(75) Inventors: Charles Grosjean, Pasadena, CA (US); Yu-Chong Tai, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 09/587,666

(22) Filed: Jun. 5, 2000

Related U.S. Application Data

(60) Provisional application No. 60/137,808, filed on Jun. 4, 1999.

(51) Int. Cl.[7] ..... F09B 45/053
(52) U.S. Cl. ..... 417/379; 417/395; 92/98 R
(58) Field of Search ..... 917/379–392, 917/394, 365–375; 92/98 R

(56) References Cited

U.S. PATENT DOCUMENTS 4,265,601 A * 5/1981 Mandroian ..... 417/379
5,346,372 A * 9/1994 Naruse et al. ..... 417/379
5,499,909 A * 3/1996 Tamada et al. ..... 417/384

* cited by examiner

*Primary Examiner*—Charles G. Freay
(74) *Attorney, Agent, or Firm*—Fish & Richardson P.C.

(57) ABSTRACT

A micropump including a chamber plate with connected pumping chambers for accepting small volumes of a fluid and a pumping structure. The pumping structure includes a flexible membrane, portions of which may be inflated into associated pumping chambers to pump the fluid out of the chamber or seal the chamber. A working fluid in cavities below the flexible membrane portions are used to inflate the membrane. The cavities may include a suspended heating element to enable a thermopneumatic pumping operation. The pumping chambers are shaped to closely correspond to the shape of the associated flexible membrane portion in its inflated state.

14 Claims, 10 Drawing Sheets

PLANAR MICROPUMP

CROSS-REFERENCE TO RELATED APPLICATION

This application claims benefit of the priority of U.S. Provisional Application Ser. No. 60/137,808, filed Jun. 4, 1999 and entitled "Thermopneumatic Peristaltic Micropump."

GOVERNMENT LICENSE RIGHTS

The U.S. Government has a paid-up license in this invention and the right in limited circumstances to require the patent owner to license others on reasonable terms as provided for by the terms of Defense Advanced Research Projects Agency (DARPA) Grant No. N66001-96-C-83632.

BACKGROUND

Micropumps are devices that can pump and valve small volumes of fluids. A number of micropumps have been demonstrated, many of them diaphragm pumps utilizing check valves and piezoelectric actuation. Some of these micropumps have demonstrated low power consumption and reasonable flow rates, but out-of-plane fluid flow may be necessary due to the absence of a good planar fluid flow check valve for such micropumps.

Some of these micropumps use semi-flexible membranes to pump fluid in and out of chambers having angular profiles. Such micropumps may exhibit leakage, backflow, and dead volume due to a mismatch between the shapes of the membrane and the chamber. Dead volume refers to a volume of fluid that is not displaced in the pump during a pumping cycle.

BRIEF DESCRIPTION OF-THE-DRAWINGS

Like reference symbols in the various drawings indicate like elements.

SUMMARY

A micropump according to an embodiment includes a pumping structure with sequential working fluid chambers, a chamber plate including pumping chambers opposing the working fluid chambers, and a flexible membrane between the pumping structure and the chamber plate and including inflatable portions between opposing working chambers and pumping chambers. The pumping chambers have a shape that substantially matches the shape of a corresponding inflatable portion in an inflated position.

According to an embodiment, the pumping chambers have a volume capacity between about 10 nl and 10 $\mu$l. The pumping chambers may be substantially linear and planar.

The working fluid chambers may be filled with a working fluid such as air, water, fluorocarbons, and alcohols. Increasing the pressure of the working fluid in the chamber may inflate the flexible membrane into the corresponding pumping chamber to displace a fluid in the chamber and/or seal the chamber. According to an embodiment, a heating element is provided in the working chamber to heat the fluid and enable a thermopneumatic pumping operation.

DESCRIPTION

Figure 1:
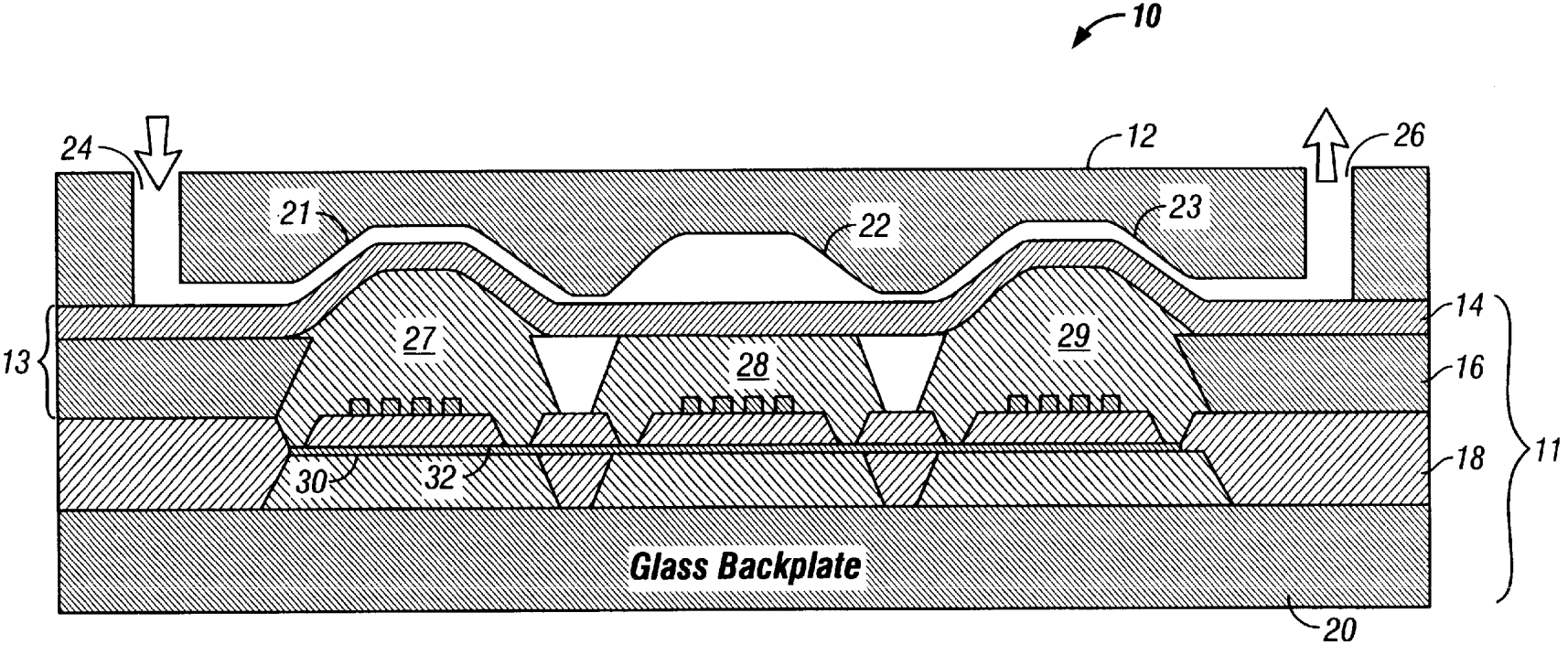
FIG. 1 is a sectional view of a micropump according to an embodiment.

FIG. 1 illustrates a micropump 10 according to an embodiment. The micropump 10 includes a pumping structure 11 and chamber plate 12. The pumping structure 11 includes a composite membrane 13, which includes a flexible membrane 14 attached to a silicon layer 16, a silicon heater layer 18, and a back plate 20 stacked to form a structure with three sequential working fluid chambers 27, 28, 29. The chamber plate 12 includes an inlet 24 and an outlet 26 for introducing and ejecting a fluid to be pumped. The inlet 24 and outlet 26 are separated by adjoining pumping chambers 21, 22, 23.

Sequential working fluid chambers 27, 28, 29 may be formed in the silicon layer 16 and silicon heater layer 18. Each working fluid chamber 27, 28, 29 is oriented below an associated pumping chamber 21, 22, 23, respectively, in the chamber plate 12. The flexible membrane 14 is interposed between the chamber plate 12 and silicon layer 16. The membrane 14 is attached at attachment portions 37, 38, 39, 40, leaving freestanding portions such as 41 of the flexible membrane 14 between those attachments. The freestanding portions cover the working fluid chambers. These may be inflated with a working fluid, such as air. The inflated portion substantially fills an associated pumping chamber as shown in 27. This action may pump fluid out of the present pumping chamber and into an adjoining pumping chamber, e.g., from chamber 21 to chamber 22, or prevent the flow of fluid into the inflated chamber, thereby providing a planar pump and valve structure.

The silicon heater layer 18 includes a heating island 30 in each working fluid chamber 27, 28, 29 to enable a thermopneumatic pumping operation. The heating islands 30 may be suspended on a silicon nitride membrane 32 over the back plate 20 to reduce heat loss from the heating island 30 to the back plate 20.

Figure 2:
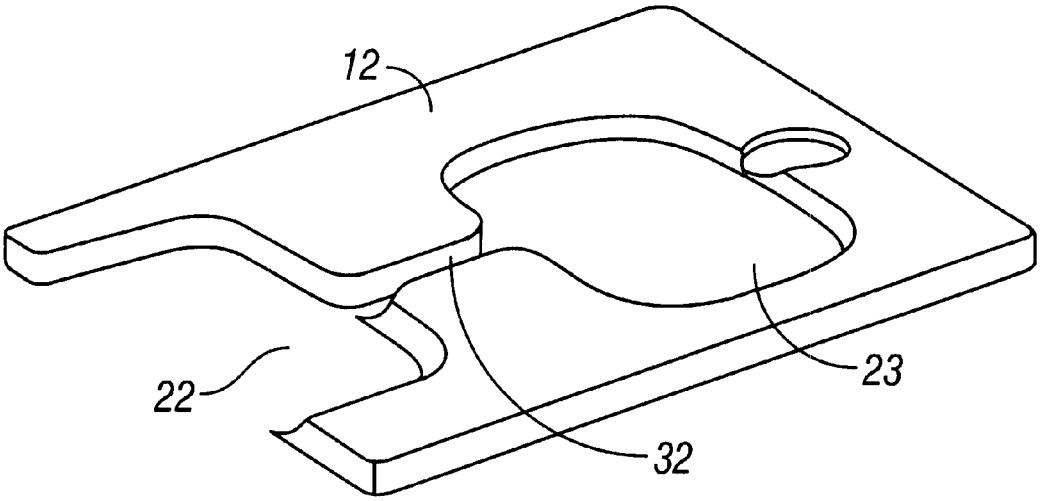
FIG. 2 is a partial perspective view of the pumping chambers in the chamber plate according to the embodiment of FIG. 1.

FIG. 2 is a partial perspective view of the top plate showing another view of the pumping chambers 22, 23. The chamber plate 12 may be, for example, an acrylic plate. The pumping chambers may be milled in the plate using a Computer Numeric Control (CNC) milling machine, such as that manufactured by Fadal Machine Centers, or other conventional precision machining techniques. The chamber plate 12 may also be fabricated by injection or compression molding a polymer to form a semi-rigid plate with integral pumping chambers.

According to an embodiment, the shape of a pumping chamber 21, 22, 23 may be determined by inflating the associated portion of the flexible membrane 14, and basing the dimensions and curvature of the pumping chamber 21, 22, 23, on the shape of the flexible membrane 14 in that state to achieve a good fit between chamber and membrane.

Each pumping chamber may be substantially symmetric and about 140 $\mu$m deep. According to alternate embodiments, the pumping chambers may be in a range of from about 20 $\mu$m to 400 $\mu$m deep. According to the present embodiment, each pumping chamber 21, 22, 23 may have a volume of about 1 $\mu$l. According to alternate embodiments, each pumping chamber may have a volume of from about 10 nl to about 10 $\mu$l.

According to an embodiment, the curvature of the sidewalls 42 of the pumping chamber may be slightly steeper than the shape of the inflated membrane 43, which may result in a slight dead volume 44 around the perimeter when the flexible membrane 14 touches the roof of the pumping chamber.

A trench joins each pumping chamber 21, 22, 23. According to the present embodiment, the trench may be 60 $\mu$m deep and about 500 $\mu$m wide.

Hypodermic and/or silicone tubing may be used for passing fluid to the inlet 24 and from the outlet 26.

The flexible membrane 14 and silicon layer 16 may be fabricated together as composite membrane 13. A layer of silicon nitride may be coated on a front side of a silicon wafer. Cavities corresponding to working chambers 27, 28, 29 may then be etched into the backside of the wafer using potassium hydroxide (KOH).

A 2 $\mu$m thick layer of a first polymer layer, for example, Parylene C manufactured by Specialty Coating Services, Inc., may be vapor deposited on the front side of the silicon wafer and patterned to cover each silicon membrane 16. A 120 $\mu$m layer of silicone rubber may then be spin coated on the front side of the wafer and cured. A silicon nitride layer may then removed from the backside of the wafer using reactive ion etching (RIE) and the wafer diced.

The Parylene C layer forms a vapor barrier which may advantageously accommodate certain working fluids used in the working chambers 27, 28, 29. The resulting flexible membrane 14 exhibits good flexibility and low permeability to certain working fluids. Other suitable materials for the flexible membrane 14 may include, for example, mylar, polyurethane, and flourosilicone. The flexible membrane 14 may be vapor deposited, spin coated, laminated, or spin coated or otherwise deposited on the silicon layer 16.

Figure 4:
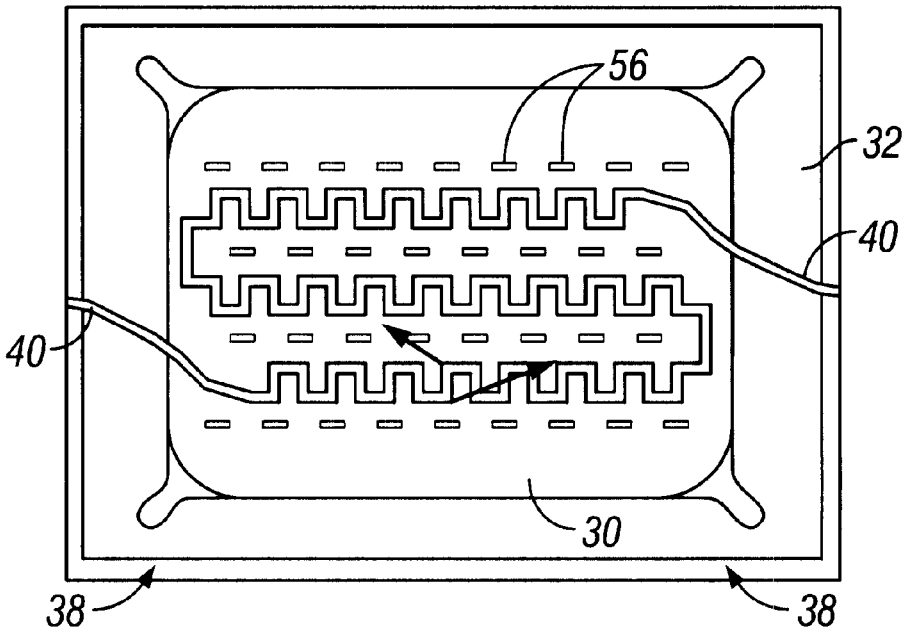
FIG. 4 is a plan view of the silicon island heater plate according to the embodiment of FIG. 1.

FIGS. 3A–3E illustrate a process for fabricating the silicon island heater 30, a plan view of which is shown in FIG. 4. The island heater 30 utilizes a relatively large surface area and low power design to distribute heat quickly throughout the working fluid while reducing thermal conduction to the back plate 20. The island heater 30 may be a perforated silicon plate 30 suspended on a silicon nitride membrane 32 as shown in FIGS. 1, 3, and 4. The silicon plate 30 acts as a heat spreader and may provide an increased surface area compared to a simple membrane. Also, as the island heater 30 is suspended in the middle of a working fluid chamber 27, 28, 29, heat loss to the back plate 20 and lateral conduction may be reduced. Two small nitride bridges 38 with conductive traces 40, e.g., gold, provide electrical connections between the island heater 30 and the back plate 20.

Figure 3A:
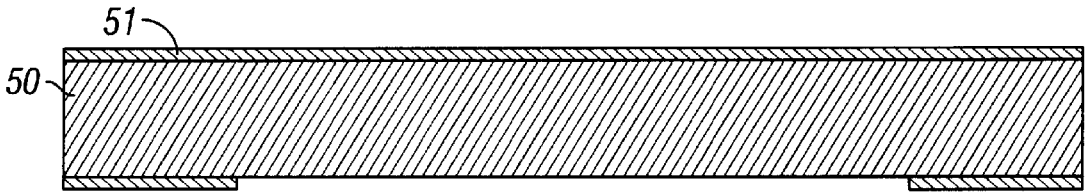
FIGS. 3A–3E are sectional views of a silicon island heater according to the embodiment of FIG. 1 in sequential stages of fabrication.
Figure 3B:
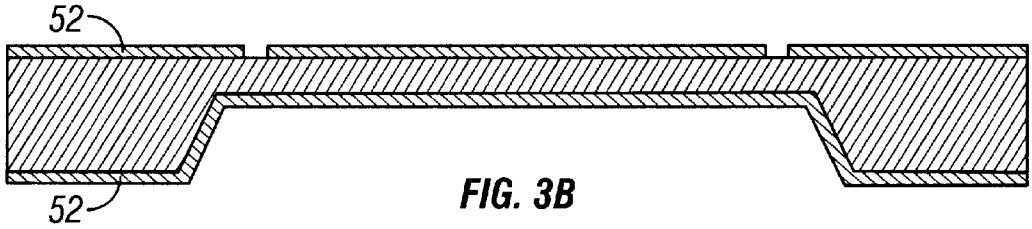
Figure 3C:
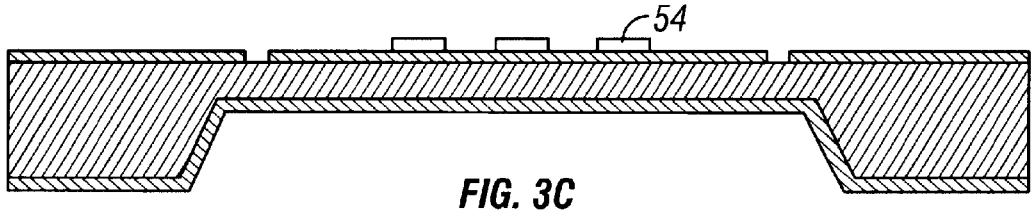
Figure 3D:
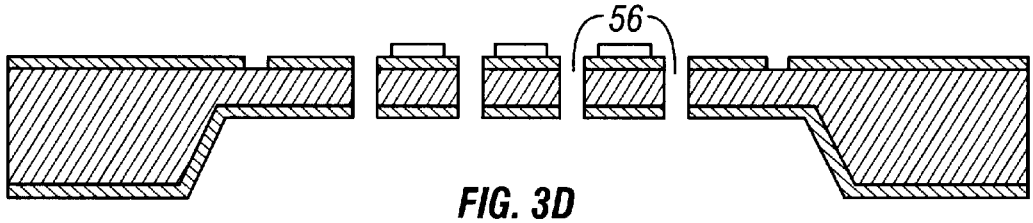
Figure 3E:
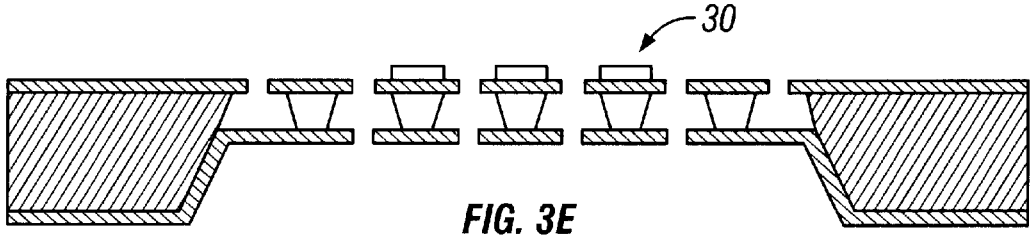

According to an embodiment, the island heater 30 may be fabricated by oxidizing a double-side polished <100> silicon wafer, as shown in FIG. 3A. The backside of the wafer 50 may be patterned and etched, e.g., with KOH, to form 30 $\mu$m thick silicon layers. The oxide layer may be stripped and a low stress silicon nitride layer 52 deposited on both sides of the wafer to form a supporting membrane on the back of the wafer and the bridge material on the front. The nitride layer 52 may then be patterned to define the bridge and island areas, as shown in FIG. 3B. A 0.7 $\mu$m layer 54 of Cr/Au may be deposited on the front of the plate to form the resistive heater, as shown in FIG. 3C. Small holes 56 may then be etched, e.g., by reactive ion etching (RIE), through the 30 $\mu$m silicon plate to form pressure equalization holes, as shown in FIG. 3D. The island heater 30 may be released by etching, e.g., with TMAH, the exposed silicon areas and undercutting the bridges, as shown in FIG. 3E.

Figure 5:
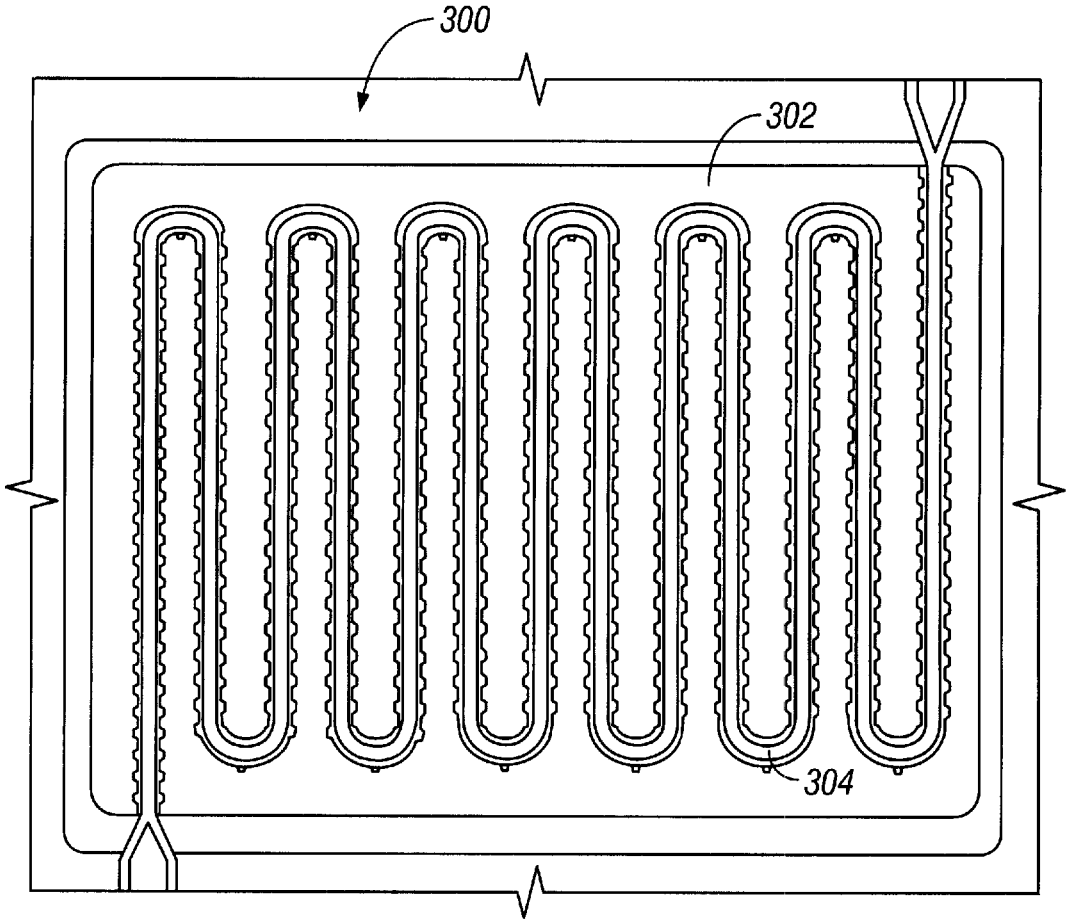
FIG. 5 is a plan view of a silicon island heater plate according to another embodiment.

FIG. 5 illustrates an island heater 300 according to another embodiment. The island heater 300 may be a perforated silicon plate 302 including a free standing meandering silicon beam 304. The silicon plate 302 with perforations 56 and silicon beam 304 may be formed simultaneously. A layer of electrically conductive material may be deposited on the wafer, or selected portions of the wafer surface heavily doped to increase conductivity. The silicon beam may be formed in the electrically conductive layer and holes formed in the plate simultaneously using an anisotropic plasma etcher. Working fluid chambers may be filled with a working fluid used to inflate the corresponding portion of the flexible membrane 14. Working fluids may be selected for their thermal conductivity, coefficient of thermal expansion, and compatibility with the material of the flexible membrane, e.g., corrosive properties. Other suitable working fluids may include, for example, water, oils and alcohols.

The chamber plate 12 may be clamped to the pumping structure 11 or permanently attached. Excessing clamping pressure may extrude a portion of the silicone membrane of the flexible membrane 14 into a pumping chamber.

Figure 6:
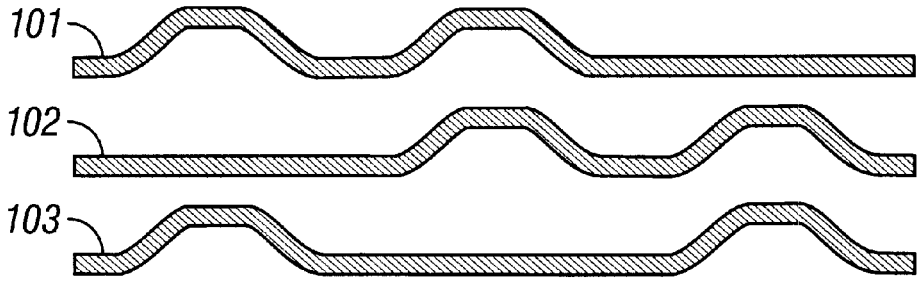
FIG. 6 is a schematic diagram illustrating phases of a three phase pumping operation according to an embodiment.

FIG. 6 illustrates a three phase pumping operation for a micropump having three pumping chambers, as shown in FIG. 1, from inlet 24 to outlet 26, i.e., in a left-to-right pumping direction. In phase 101, chambers 21 and 22 are sealed and chamber 23 open. In phase 102, chamber 101 is opened to accept a volume of fluid from the inlet 24, and chamber 23 is sealed, which may pump a remaining volume of fluid in chamber 23 out through the outlet 26. In phase 103, chamber 21 is closed, pushing the volume of fluid in chamber 21 to chamber 22. Returning to phase 101, this volume of fluid may be pushed into chamber 23, and the cycle repeated.

Figure 7:
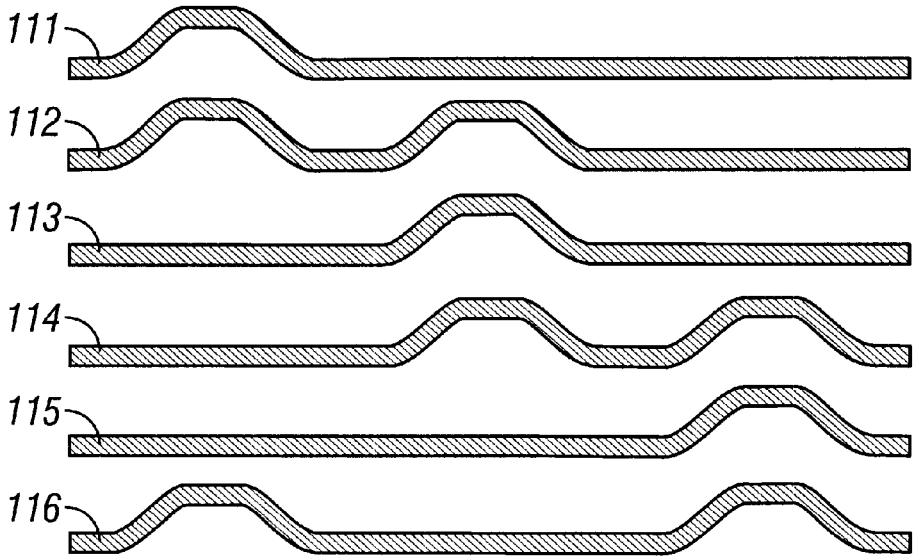
FIG. 7 is a schematic diagram illustrating phases of a six phase pumping operation according to another embodiment.

FIG. 7 illustrates a similar pumping operation for a micropump with three pumping chambers, but performed in six phases 111, 112, 113, 114, 115, 116. In phase 111, chamber 21 is sealed and chambers 22 and 23 are open. In phase 112, chamber 22 is sealed, which may push a volume of fluid in chamber 22 into 23, thereby pumping any fluid in chamber 23 through the outlet 26. In phase 113, chamber 21 is opened to accept a volume of fluid from inlet 24. In phase 114, chamber 23 is sealed, pushing the volume of fluid currently in chamber 23 out through outlet 26 in phase 115, chambers 21 and 22 are opened to accept another volume of fluid. In phase 116, chamber 21 is sealed, pushing the volume of fluid into chamber 22, the cycle repeated. This operation pumps twice the volume of fluid at the same frequency as the three phase operation of FIG. 6, but in twice as many phases.

Figure 8:
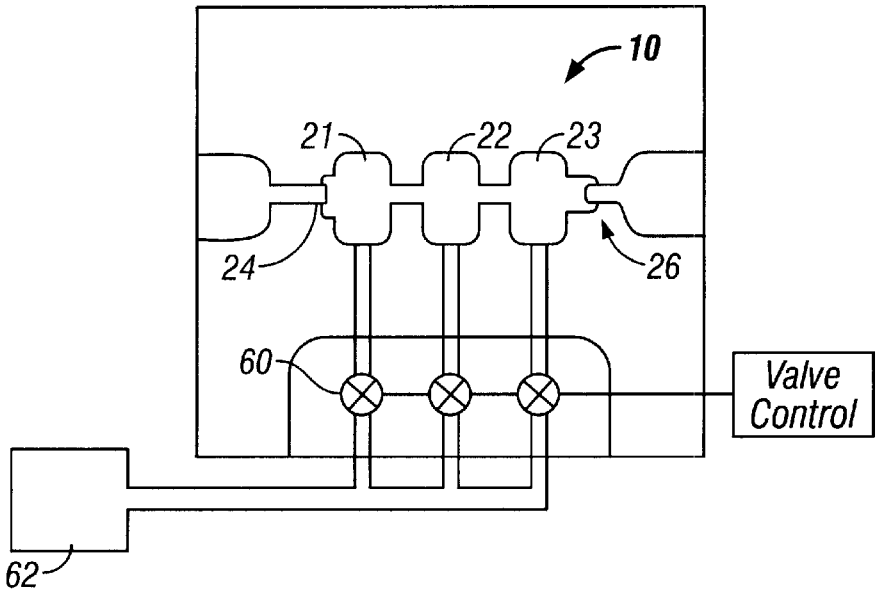
FIG. 8 is a sectional view of an asymmetric pumping chamber according to an embodiment.

A micropump 10 according to the present embodiment may be pneumatically actuated with external valves. FIG. 8 illustrates a valve assembly including electrically controlled valves 60 connected to a pressurized air source 62 to pneumatically actuate the micropump 10.

In an embodiment including symmetric pumping chambers, it may be desirable to bias the flexible membrane 14 towards the inlet 24 so that upon actuation, the inflated membrane seals the inlet 24 first and then compresses the fluid to be pumped. According to an embodiment, the chamber plate 12 may be positioned on the pumping structure 11 such that the pumping chambers are slightly offset from the working chambers. The flexible membrane may be more flexible toward the center of the working fluid chamber, and offsetting the pumping chambers may produce a tighter seal between the flexible membrane 14 and the inlet 24.

Figure 9:
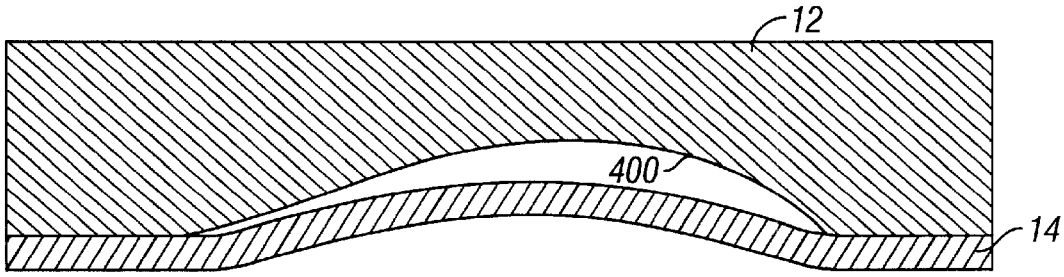
FIG. 9 is a schematic diagram of a pneumatically operated micropump according to an embodiment.

FIG. 9 illustrates an asymmetric pumping chamber 400 according to another embodiment. The asymmetric shape of the chamber tends to bias the flexible membrane 14 to form a seal on one side (left side in FIG. 9) before the flexible membrane 14 inflates completely.

A pneumatic pumping operation was performed using a micropump 10 according to the present embodiment. It was determined that the inflation pressure in the working chambers 27, 28, 29 may affect how well the flexible membrane 14 seals the inlet 24 and the compression ratio in the fluid. At pressures below about five psi, it was found that the micropump 10 was not self-priming due to poor sealing. At inflation pressures between five and nine psi, the pump was self-priming with a similar volume flow rate for pumping air and water. The flow rate was reduced for lower inflation pressures due to less complete filling of the chambers.

Figure 10:
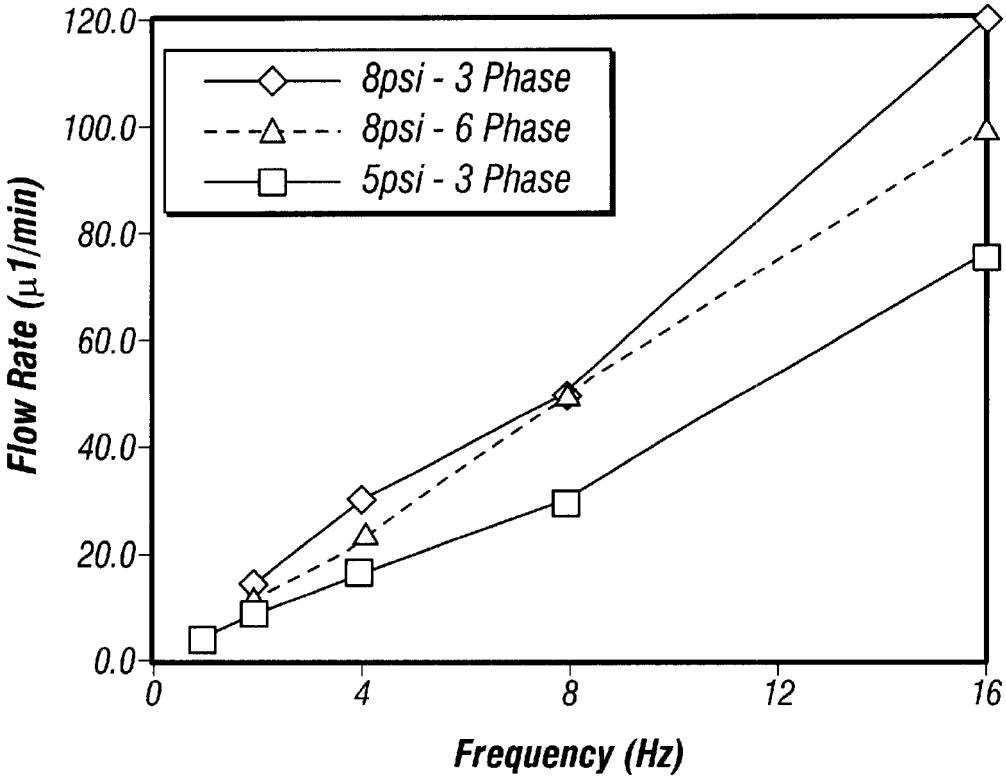
FIG. 10 is a chart illustrating the flow rate vs. frequency performance of the micropump according to the embodiment of FIG. 1 during a pneumatic pumping operation.

Three phase and six phase actuation sequences, as shown in FIGS. 6 and 7, were performed. FIG. 10 shows the flow rate vs. frequency performance for the two different actuation sequences. The flow rates are very similar for the same operational frequency, with up to 120 $\mu$l/min at sixteen Hz. The lower flow rate for the six phase sequence may be due to the fact that the chamber was offset by a slightly larger amount to achieve better sealing, thereby reducing the compression ratio in the fluid. Further, since the three phase sequence has two membranes in the actuated state in each phase, sealing from inlet 24 to outlet 26 may be improved.

Figure 11:
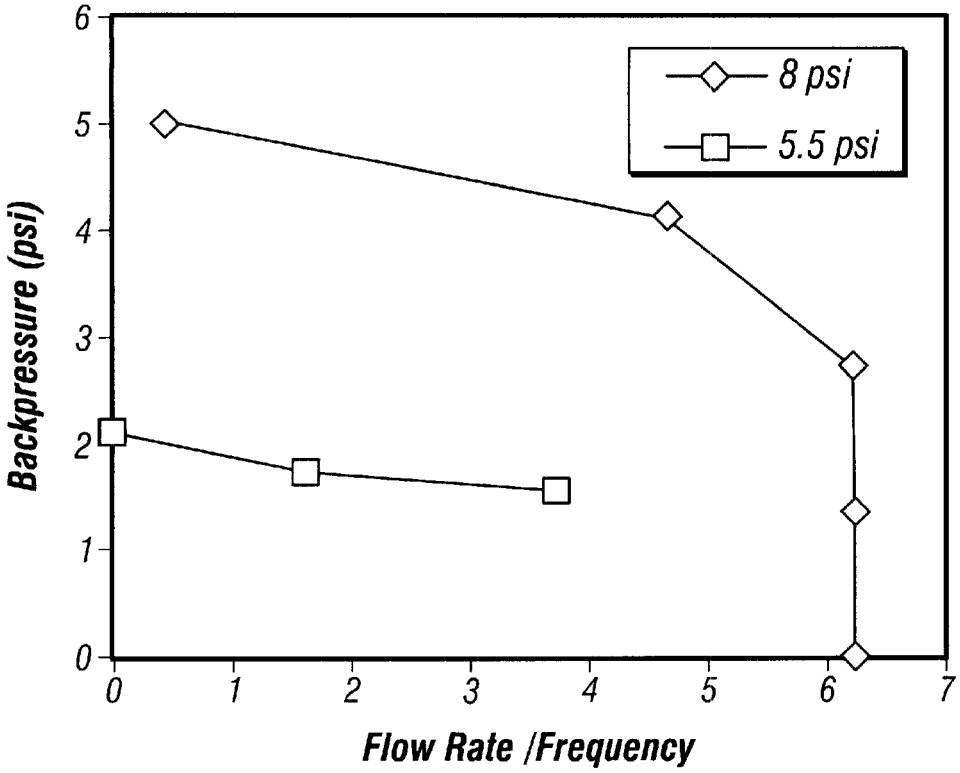
FIG. 11 is a chart illustrating flow rate vs. backpressure of the micropump according to the embodiment of FIG. 1 for two different pneumatic pumping operations.

Flow rate versus back pressure was also characterized for the pneumatic pumping operation at various frequencies and actuation pressures. FIG. 11 shows normalized flow rate data vs. backpressure for actuation pressures of 8 psi and 5.5 psi. The membrane actuation pressure has a fairly linear relationship to the maximum backpressure.

A thermopneumatic pumping operation was performed using a micropump 10 according to the present embodiment. The island heater 30 may provide a large surface area at uniform temperature while minimizing heat conduction to the back plate 20. To verify proper operation, the heater 10 was mounted on a hot chuck set to 60° C. to minimize background noise. An infrared microscope (Infrascope™) was used to measure the temperature distribution. With 190 mW of applied power, the island heater 30 reached 126° C., 66° C. above the back plate 20 temperature.

Due to the small size of the holes 56 in the island heater 30, and the overhanging $Si_xN_y$ structure formed by the TMAH etch undercut (FIG. 3E), surface tension made it difficult to completely fill the chambers with a working liquid. A vacuum was used to remove air between the island heater 30 and flexible membrane 14 for a 100% liquid fill, in this case a perfluorocarbon fluid sold under the trade name Fluorinert of the type PF5080 manufactured by 3M. Fluorinert was selected as a working fluid for the thermopneumatic pumping operation as it advantageously exhibits a high thermal expansion coefficient.

The pressure generated by the heating of the working fluid was in the range of about four to five psi. The micropump 10 was clamped to a plate of aluminum to increase the cooling rate of the working fluid at the expense of increased power dissipation. Initial testing was performed with a fluorinert (PF5080) filled actuator operated with five phases at one Hz. The maximum flow rate achieved was 4.2 $\mu$l/min and the micropump 10 was self-priming.

Air was also used as a working fluid for a thermopneumatic pumping operation with a six phase sequence running at two Hz and four Hz. A maximum liquid flow rate of 6.3 $\mu$l/min was achieved at four Hz with self-priming operation. As shown in Table 1, air had similar deflection vs. power characteristics as fluorinert (PF5080), but exhibited better filling and a faster transient response.

TABLE 1

Flow Rates for Thermopneumatic Pumping

| Time per Phase (s) | Working Fluid | # of Phases | Flow Rate ($\mu$l/min) | Power (mW) |
|---|---|---|---|---|
| 1 | PF5080 | 5 | 4.2 | 400 |
| 0.5 | air | 6 | 4.3 | 291 |
| 0.25 | air | 6 | 6.3 | 291 |

Figure 12:
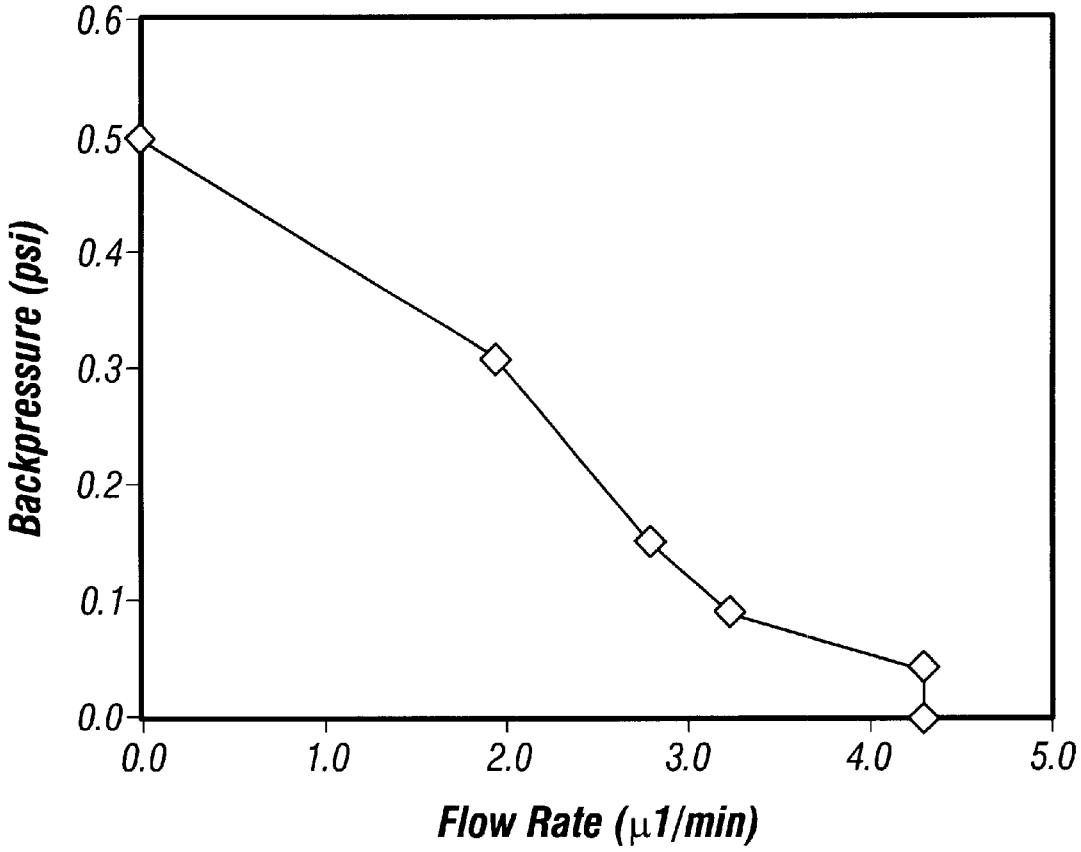
FIG. 12 is a chart illustrating flow rate vs. backpressure of the micropump according to the embodiment of FIG. 1 during a thermopneumatic pumping operation.
Figure 13:
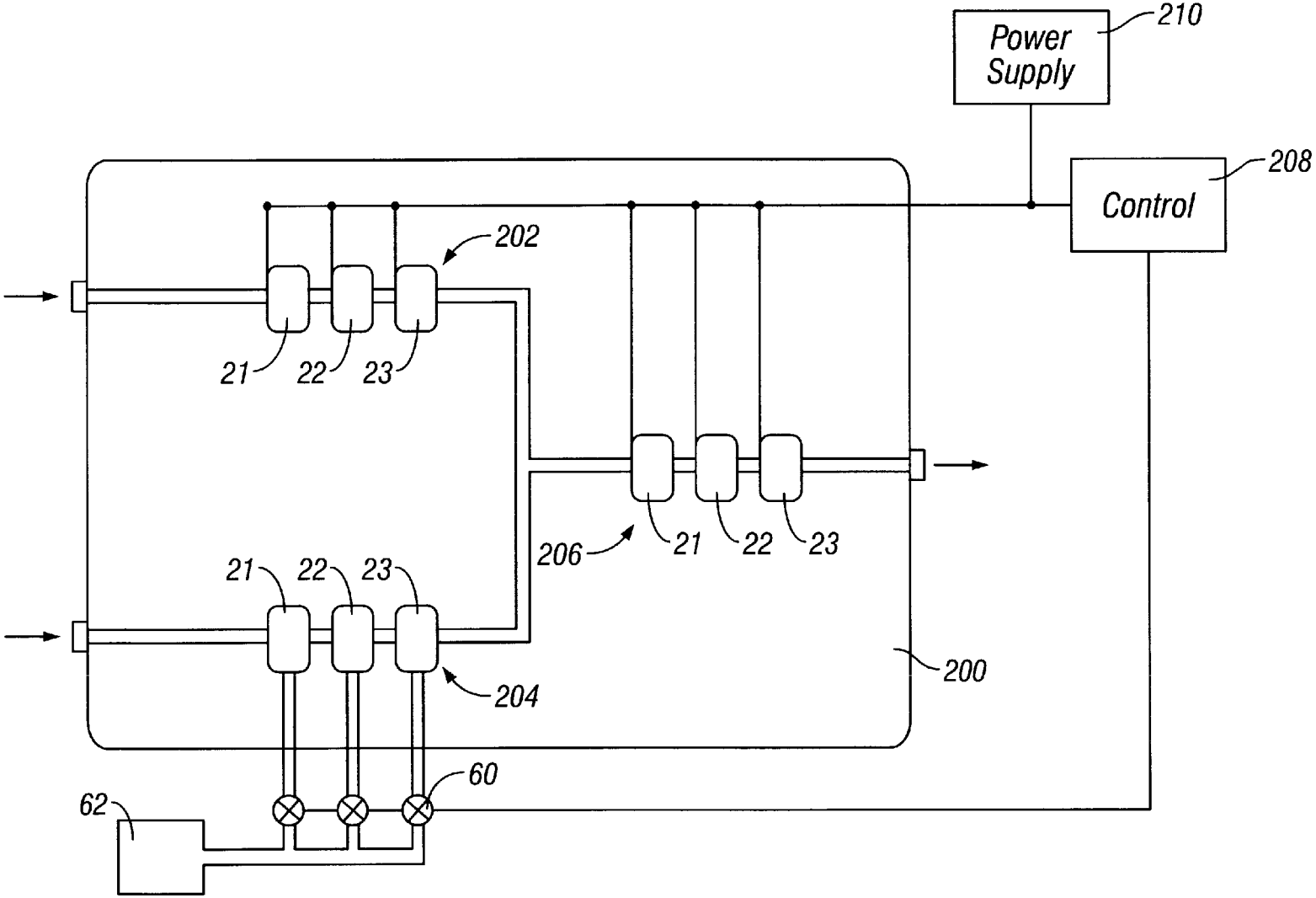
FIG. 13 is a schematic diagram of a card-type fluid processing module including micropumps according to an embodiment.
Figure 14:
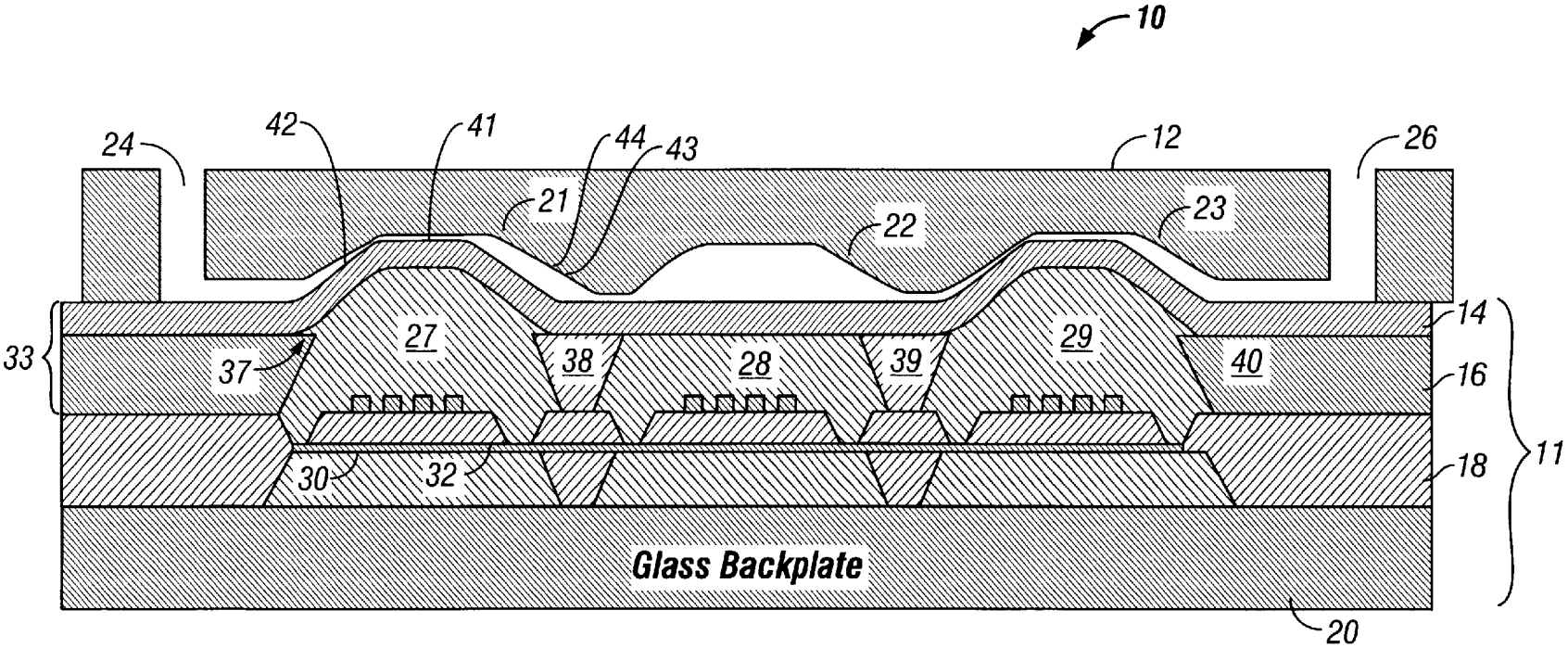
FIG. 14 is a sectional view of a micropump according to an alternative embodiment.

The backpressure was also characterized for the thermopneumatic micropump 10 operating at two Hz using air as a working fluid, as shown in FIG. 12. Compared to pneumatic operation, the backpressure achieved decreased significantly, indicating that the pressure generated by the air-filled thermopneumatic actuator is less than five psi.

According to an embodiment, a number of micropump structures 10 are integrated into a compact fluidic system that can handle mixing and delivery of fluids in small volumes. According to an embodiment, micropump structures are combined to reproduce a fairly complex bench process on a card-type module 20, as shown in FIG. 12. The micropumps 202, 204, 206 may be thermopneumatically actuated by an integrated heater/fluid structure or actuated by external valves 60, controller 208, and power supply 210. A single chamber/membrane combination can also be used as a normally open valve. This valve does not need to be formed discretely as any one of the several chambers in the pumping structure 11 may be actuated individually to operate as a valve. Such a card-type module 20 with a combination of pumps, valves, and fluidic channels may be produced as a planar structure. Such a card-type module 20 may be used for processing biological samples and may be disposable.

According to various embodiments, a micropump with a planar, single-layer structure that can pump and valve a fluid may be provided.

A number of embodiments of the invention have been described. Nevertheless, it will be understood that various modifications may be made without departing from the spirit and scope of the invention. Accordingly, other embodiments are within the scope of the following claims.

What is claimed is:

1. A micropump comprising:

a pumping structure comprising an inlet, an outlet, and a plurality of adjacent working fluid chambers, each working fluid chamber opening at one end into a surface of the pumping structure;

a chamber plate comprising a plurality of adjacent pumping chambers and a plurality of channels connecting adjacent pumping chambers, each of said pumping chambers being aligned with a corresponding one of the working fluid chambers in the chamber plate;

a flexible membrane between the pumping structure and the chamber plate and including a plurality of inflatable portions between opposing working chambers and pumping chambers, said inflatable portions having a shape in an inflated state substantially matching the shape of a corresponding pumping chamber; and means for biasing each of said plurality of inflatable portions toward the inlet in the inflated state.

2. The micropump of claim 1, wherein each pumping chamber has a volume capacity in a range of from about 10 nl to about 10 $\mu$l.

3. The micropump of claim 1, wherein the pumping chambers are aligned substantially linearly.

4. The micropump of claim 1, wherein the pumping chambers have a substantially symmetrical shape.

5. The micropump of claim 1, wherein each of the working chambers is adapted to connect to an external pneumatic source for inflating the flexible membrane.

6. The micropump of claim 1, wherein each of said working fluid chambers comprises a working fluid.

7. The micropump of claim 6, wherein the working fluid is selected from the group comprising air, water, fluorocarbons, oils, and alcohols.

8. The micropump of claim 1, wherein each of said working chambers further comprises a heating element adapted to heat a working fluid in the working chamber.

9. The micropump of claim 1, wherein the flexible membrane comprises silicone rubber.

10. The micropump of claim 1, further comprising a card substrate incorporating the pumping structure.

11. A micropump comprising:

a pumping structure comprising a plurality of adjacent working fluid chambers, each working fluid chamber opening at one end into a surface of the pumping structure;

a chamber plate comprising a plurality of adjacent pumping chambers and a plurality of channels connecting adjacent pumping chambers, each of said pumping chambers being aligned with a corresponding one of the working fluid chambers in the chamber plate; and a flexible membrane between the pumping structure and the chamber plate and including a plurality of inflatable portions between opposing working chambers and pumping chambers, said inflatable portions having a shape in an inflated state substantially matching the shape of a corresponding pumping chamber, wherein the pumping chambers have an asymmetric shape biased such that one side of the chamber seals as the flexible membrane is inflated.

12. A micropump comprising:

a pumping structure comprising a plurality of adjacent working fluid chambers, each working fluid chamber opening at one end into a surface of the pumping structure;

a chamber plate comprising a plurality of adjacent pumping chambers and a plurality of channels connecting adjacent pumping chambers, each of said pumping chambers being aligned with a corresponding one of the working fluid chambers in the chamber plate; and a flexible membrane between the pumping structure and the chamber plate and including a plurality of inflatable portions between opposing working chambers and pumping chambers, said inflatable portions having a shape in an inflated state substantially matching the shape of a corresponding pumping chamber, wherein each of said working chambers further comprises a heating element adapted to heat a working fluid in the working chamber, and wherein said heating element comprises a resistive heater suspended over a base of the working fluid chamber.

13. A micropump comprising:

a pumping structure comprising an inlet, an outlet, and a plurality of adjacent working fluid chambers, each working fluid chamber opening at one end into a surface of the pumping structure;

a chamber plate comprising a plurality of adjacent pumping chambers and a plurality of channels connecting adjacent pumping chambers, each of said pumping chambers being aligned with a corresponding one of the working fluid chambers in the chamber plate, wherein each of said pumping chambers is aligned with and offset from a corresponding one of the working fluid chambers in the chamber plate; and a flexible membrane between the pumping structure and the chamber plate and including a plurality of inflatable portions between opposing working chambers and pumping chambers, said inflatable portions having a shape in an inflated state substantially matching the shape of a corresponding pumping chamber.

14. A micropump comprising:

a pumping structure comprising an inlet, an outlet, and a plurality of adjacent working fluid chambers, each working fluid chamber opening at one end into a surface of the pumping structure;

a chamber plate comprising a plurality of adjacent pumping chambers and a plurality of channels connecting adjacent pumping chambers, each of said pumping chambers being aligned with a corresponding one of the working fluid chambers in the chamber plate; and a flexible membrane between the pumping structure and the chamber plate and including a plurality of inflatable portions between opposing working chambers and pumping chambers, said inflatable portions having a shape in an inflated state substantially matching the shape of a corresponding pumping chamber, wherein each of said plurality of inflatable portions includes a central portion and a peripheral portion surrounding the center portions, the central portion being more flexible than the peripheral portion.

* * * * *